US007864012B2

(12) United States Patent
Merck et al.

(10) Patent No.: US 7,864,012 B2
(45) Date of Patent: Jan. 4, 2011

(54) INDUCTIVE COUPLER FOR POWER LINE COMMUNICATIONS, HAVING A MEMBER FOR MAINTAINING AN ELECTRICAL CONNECTION

(75) Inventors: Erik Steck Merck, Sharon, MA (US); Yehuda Cern, Efrat, IL (US)

(73) Assignee: Ambient Corporation, Newton, MA (US)

( * ) Notice: Subject to any disclaimer, the term of this patent is extended or adjusted under 35 U.S.C. 154(b) by 305 days.

(21) Appl. No.: 11/919,295

(22) PCT Filed: May 19, 2006

(86) PCT No.: PCT/US2006/019452

§ 371 (c)(1),
(2), (4) Date: Oct. 25, 2007

(87) PCT Pub. No.: WO2007/027250

PCT Pub. Date: Mar. 8, 2007

(65) Prior Publication Data

US 2009/0278645 A1 Nov. 12, 2009

(51) Int. Cl.
*H01F 17/06* (2006.01)

(52) U.S. Cl. ..... 336/175; 336/176; 336/92

(58) Field of Classification Search ..... 336/175, 336/176, 92

See application file for complete search history.

(56) References Cited

U.S. PATENT DOCUMENTS

| | | | | |
|---|---|---|---|---|
| 5,003,278 | A * | 3/1991 | May | 336/92 |
| 5,243,127 | A * | 9/1993 | Kitagawa | 174/377 |
| 5,400,006 | A * | 3/1995 | Cardozo | 336/175 |
| 5,990,756 | A * | 11/1999 | France et al. | 333/12 |
| 6,262,361 | B1 * | 7/2001 | Konz | 174/377 |
| 7,040,003 | B2 * | 5/2006 | Hall et al. | 29/602.1 |
| 7,170,367 | B2 * | 1/2007 | Cern | 333/24 R |

FOREIGN PATENT DOCUMENTS

| | | |
|---|---|---|
| WO | WO 03/094365 | 11/2003 |
| WO | WO 2004/036601 | 4/2004 |

OTHER PUBLICATIONS

International Search Report Application No. PCT/US06/19452, dated Oct. 26, 2006.

* cited by examiner

*Primary Examiner*—Lincoln Donovan
*Assistant Examiner*—Joselito Baisa
(74) *Attorney, Agent, or Firm*—Ohlandt, Greeley, Ruggiero & Perle, LLP

(57) ABSTRACT

There is provided an inductive coupler for coupling a signal to a conductor. The inductive coupler includes (a) a magnetic core having an aperture through which the conductor is routed, (b) a winding wound around a portion of the magnetic core, where the signal is coupled between the winding and the conductor via the magnetic core, and (c) a member that maintains an electrical connection between the magnetic core and the conductor.

7 Claims, 18 Drawing Sheets

INDUCTIVE COUPLER FOR POWER LINE COMMUNICATIONS, HAVING A MEMBER FOR MAINTAINING AN ELECTRICAL CONNECTION

BACKGROUND OF THE INVENTION

1. Field of the Invention

The present invention relates to power line communications, and more particularly, to a configuration of a data coupler for power line communications.

2. Description of the Related Art

Power line communications (PLC), also known as broadband over power line (BPL), is a technology that encompasses transmission of data at high frequencies through existing electric power lines, i.e., conductors used for carrying a power current. A data coupler for power line communications couples a data signal between a power line and a communication device such as a modem.

An example of such a data coupler is an inductive coupler that includes a set of cores, and a winding wound around a portion of the cores. The inductive coupler operates as a transformer, where the cores are situated on a power line such that the power line serves as a primary winding of the transformer, and the winding of the inductive coupler is a secondary winding of the transformer.

The cores are typically constructed with magnetic materials, such as ferrites, powdered metal, or nano-crystalline material. The cores are electrified by contact with the power line and require insulation from the secondary winding. Typically, insulation is provided between the cores and secondary winding by embedding both the cores and the secondary winding in electrically insulating material, such as epoxy.

Connection of the cores over the power line must remain consistent for the frequency signals to continue to transmit without loss or interference. A variety of different power line cables are used in the power line industry, and so, consequently, there are a variety of cross-sectional diameters of these power line cables in the existing power line environment. Regardless of this environment, there is a need for an inductive coupler configured to maintain a consistent electrical connection between the magnetic cores and the power line.

SUMMARY OF THE INVENTION

There is provided an inductive coupler for coupling a signal to a conductor. The inductive coupler includes (a) a magnetic core having an aperture through which the conductor is routed, (b) a winding wound around a portion of the magnetic core, where the signal is coupled between the winding and the conductor via the magnetic core, and (c) a member that maintains an electrical connection between the magnetic core and the conductor.

DESCRIPTION OF THE INVENTION

In a PLC system, power current is typically transmitted through a power line at a frequency in the range of 50-60 hertz (Hz). In a low voltage line, power current is transmitted with a voltage between about 90 to 600 volts, and in a medium voltage line, power current is transmitted with a voltage between about 2,400 volts to 35,000 volts. The frequency of the data signals is greater than or equal to about 1 megahertz (MHz), and the voltage of the data signal ranges from a fraction of a volt to a few tens of volts.

Figure 1:
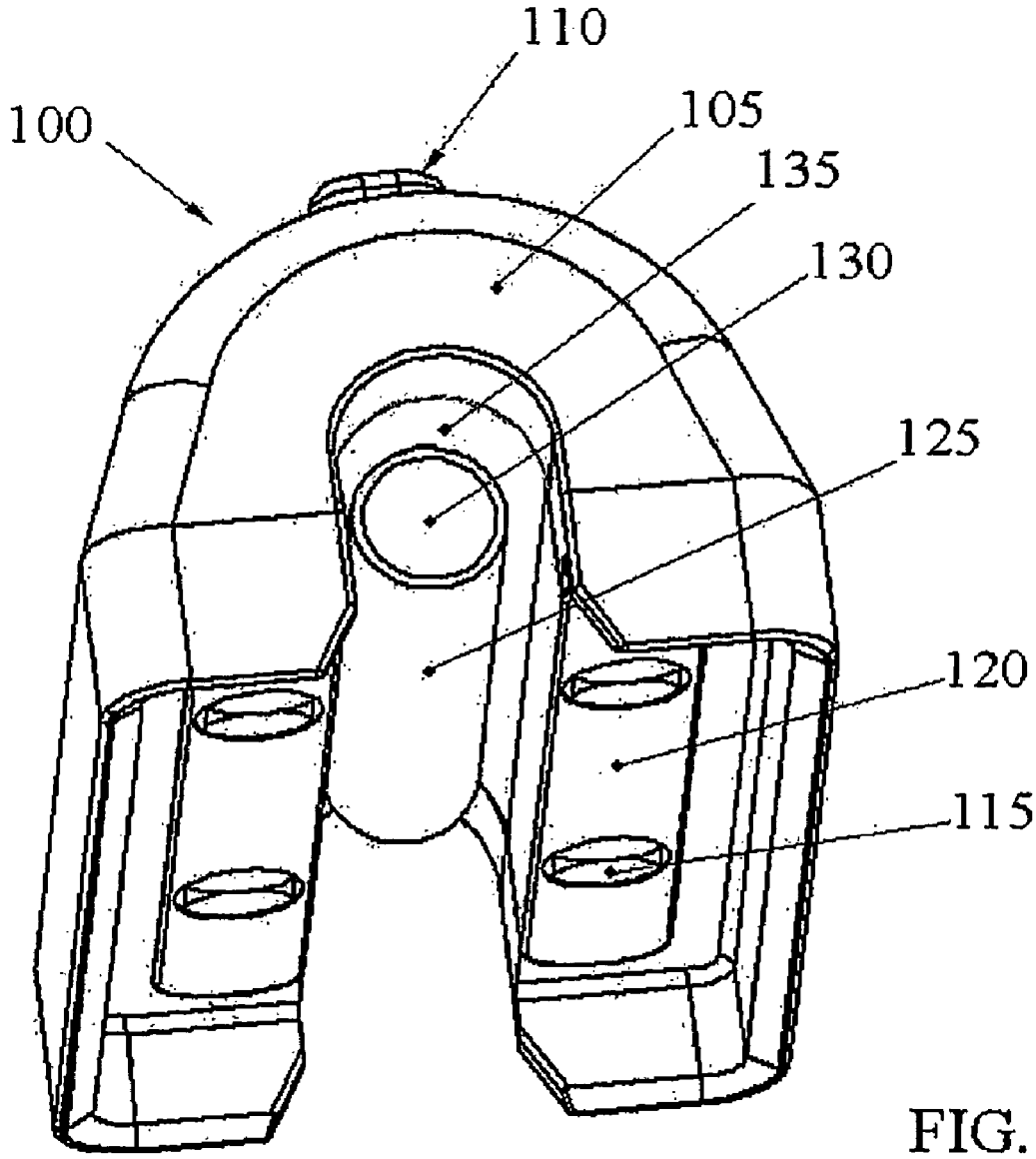
FIG. 1 is a three-dimensional view of an inductive coupler cover having a member fabricated of a conductive material configured as a compressible closed profile, located on the inside aperture of an upper magnetic core portion.

FIG. 1 is a three-dimensional view of a cover 100 for an inductive coupler. Cover 100 has a magnetic core section 115 enclosed within a sheath 120. Sheath 120 is fabricated of either a conductive material or a semiconductive material. Insulation 105 surrounds an outer surface of sheath 120. A member 125 having an internal opening 130 is fastened or placed within magnetic core section 115, inside an aperture 135. Member 125 has a "closed" profile. The term "closed" profile is used for defining a specific configuration where the material of the "closed" profile maintains a uniformed cross-section with one or more openings of space through the uniformed cross-section. Cover 100 also includes a handle 110 to allow a person to hold cover 100 during installation of the inductive coupler onto a power line.

Figure 2:
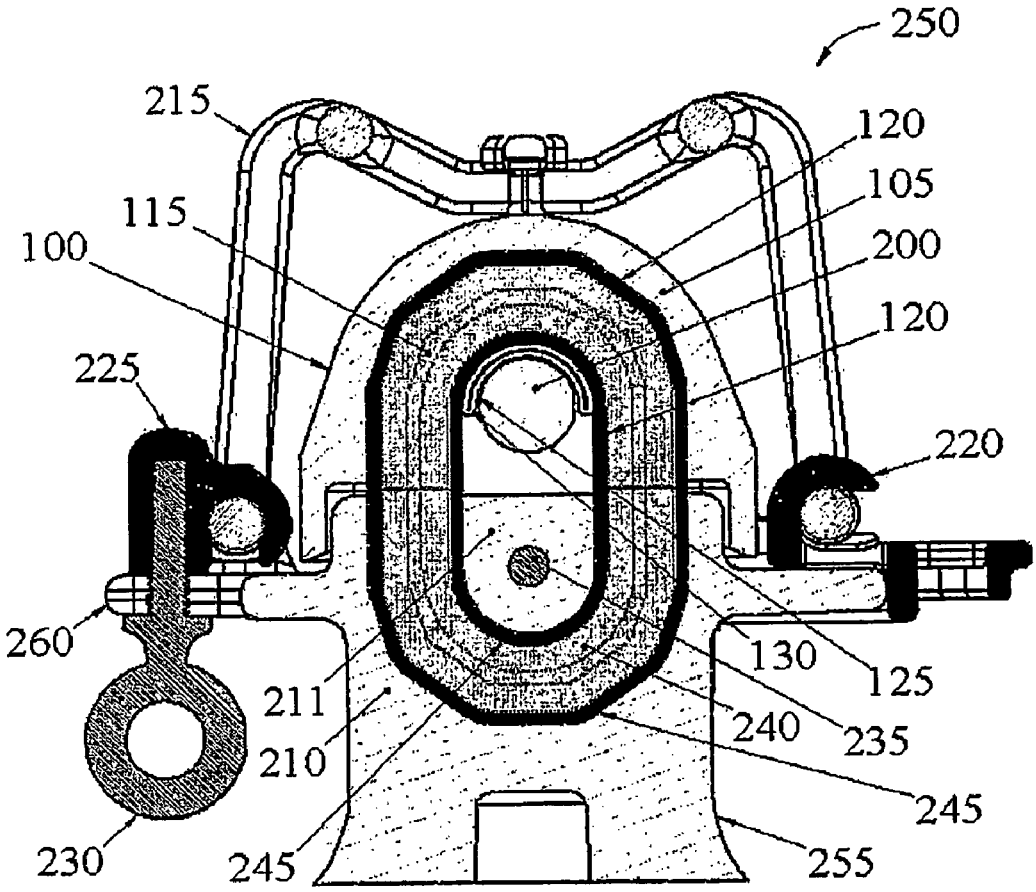
FIG. 2 is a cross-sectional view of an inductive coupler having a member fabricated of a conductive material configured as a closed profile, compressed to maintain a constant connection between a magnetic core and a power line.
Figure 2A:
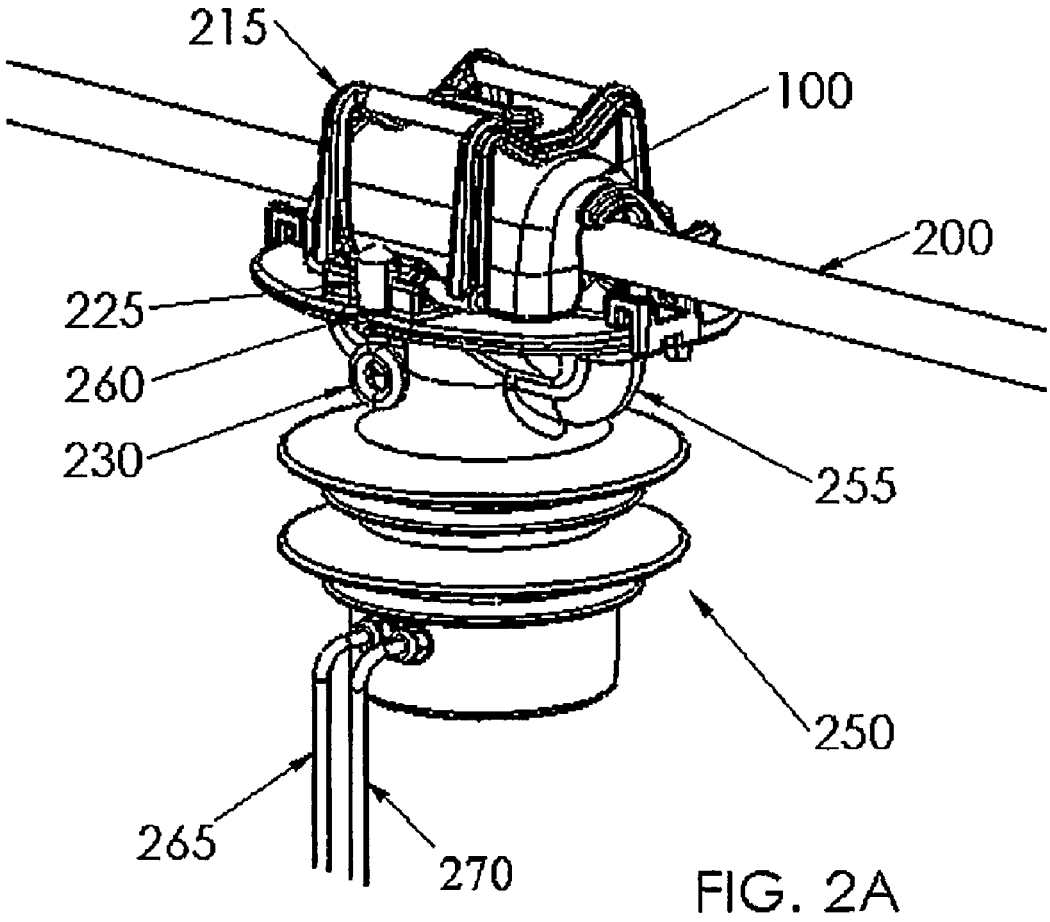
FIG. 2A is an illustration of an inductive coupler installed on an electrical power line.

FIG. 2 is a cross-sectional view of an inductive coupler 250, and FIG. 2A is an illustration of inductive coupler 250 installed on a power line 200. Inductive coupler 250 includes cover 100 seated over power line 200 above a base 255. As mentioned above, magnetic core section 115 is embedded within cover 100 and surrounded with sheath 120. Sheath 120 comes in contact with a conductive coating 245, which surrounds a magnetic core section 240 that is embedded within base 255. Magnetic core sections 115 and 240, have C-shaped cross-sections, and are situated adjacent to one another to form an aperture through which power line 200 is routed. Together, magnetic core sections 115 and 240 form a magnetic core. A winding 235 is wound around a portion of magnetic core section 240. Inductive coupler 250 operates as a transformer, where power line 200 serves as a primary winding of the transformer, and winding 235 is a secondary winding of the transformer.

Referring to FIG. 2A, one end of secondary winding 235 is connected to cable 265 while the other end of secondary winding 235 is connected to cable 270. Cable 265 can be directly connected to electrical ground (not shown), while cable 270 provides a data signal connection to electrical equipment (not shown). Alternatively both cable 265 and cable 270 can be connected to the electrical equipment, where the electrical equipment provides a path to electrical ground.

Referring again to FIG. 2, winding 235 is shown as a single turn winding, but in practice, winding 235 may be wound around magnetic core section 240 two or more times. Magnetic core section 240 is embedded in insulation 210, and insulation 211 is situated between magnetic core section 240 and winding 235. Insulation 105, insulation 210, and insulation 211 are fabricated of an electrically insulating material, such as epoxy. Insulation 210 and insulation 211 are shown in FIG. 2 divided by magnetic core section 240, however, in practice, magnetic core 240 and winding 235 are embedded within insulation 210 and insulation 211. That is, insulation 210 and insulation 211 are contiguous with one another.

Base 255 includes a shed slot 260. A locking arm 215 is closed over cover 100 and captured in a final position with a pivot nut 225 that is rotated so that an eyebolt 230 is positioned in shed slot 260. Locking arm 215 is captured on an opposite side of cover 100 with a fastening hook snap connection 220. Locking arm 215 applies force on cover 100 entrapping power line 200 between magnetic core sections 115 and 240.

When inductive coupler 250 is installed onto power line 200, member 125 is situated adjacent to power line 200. The weight of inductive coupler 250 forces member 125 to compress onto itself, reducing internal opening 130. The location of power line 200 inside aperture 135 an/or the cross-section diameter of power line 200 can also influence the force being applied to compress member 125.

A permanent set is a condition where a material, when compressed into a form, holds that form rather than returning to its original form. Preferably, member 125 does not take a permanent set, but is instead, resilient. That is, member 125, after being compressed, tends to return to its non-compressed form. Member 125 is made of a conductive or semiconductive material. By not taking a permanent set, member 125 allows movement of power line 200, while maintaining a continual conductive or semiconductive connection between power line 200 and magnetic core section 115. This continual connection is important for enabling inductive coupler 250 to provide clear frequency signal performance when coupling a data signal.

Figure 3:
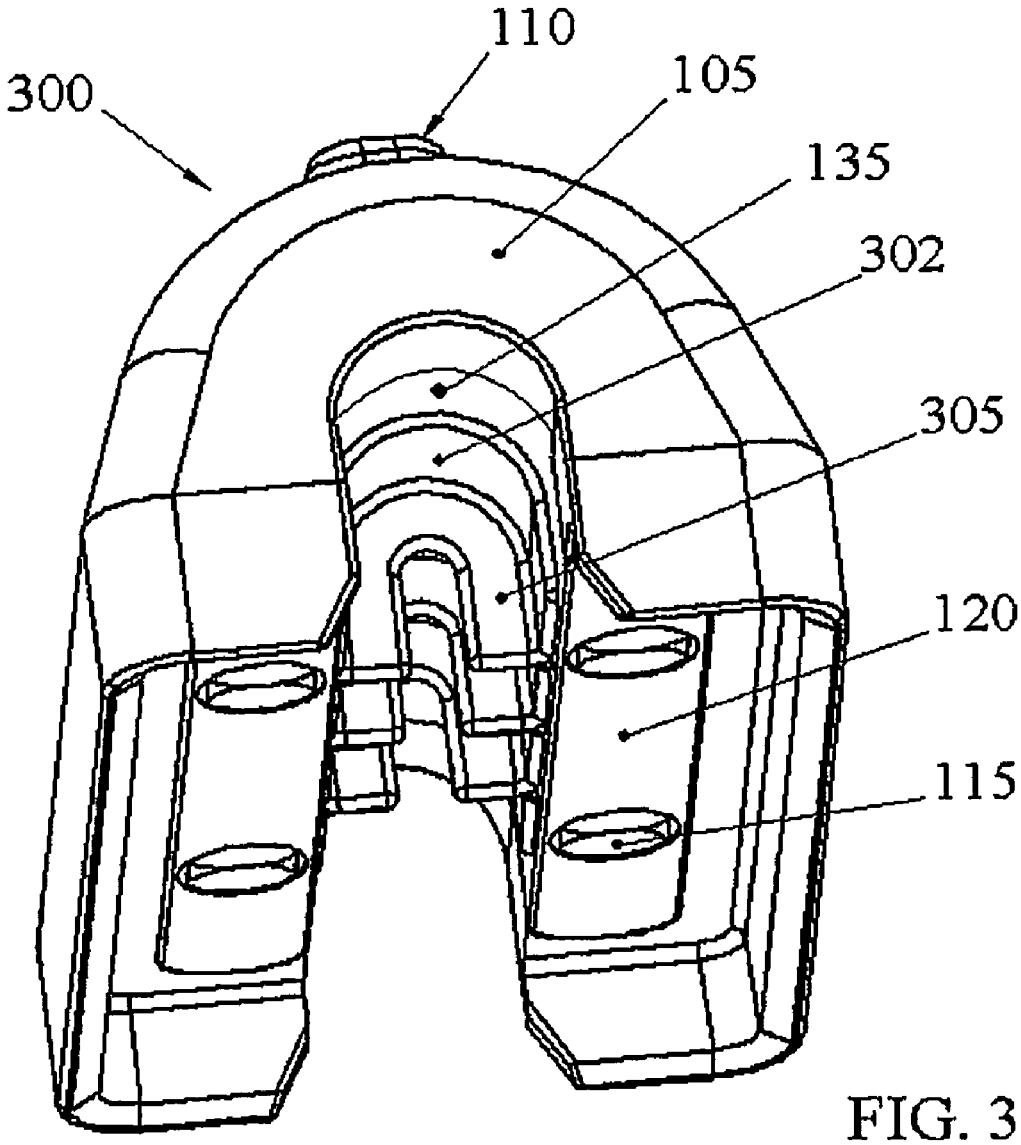
FIG. 3 is a three-dimensional view of an inductive coupler cover having a member fabricated of a conductive material configured as a compressible open profile, located on the inside aperture of an upper magnetic core portion.

FIG. 3 illustrates a three-dimensional view of a cover 300 that employs a power line connection 302 that includes a member 305. Member 305 has an "open" profile, and is fabricated of a conductive or semiconductive material that when brought into contact with power line 200 collapses onto itself so that there is at least one layer of material of member 305 between magnetic core section 115 and power line 200. Member 305 deflects under load thus maintaining an electrical contact with power line 200 regardless of power line 200's cross-sectional diameter size or position within aperture 135.

Figure 4:
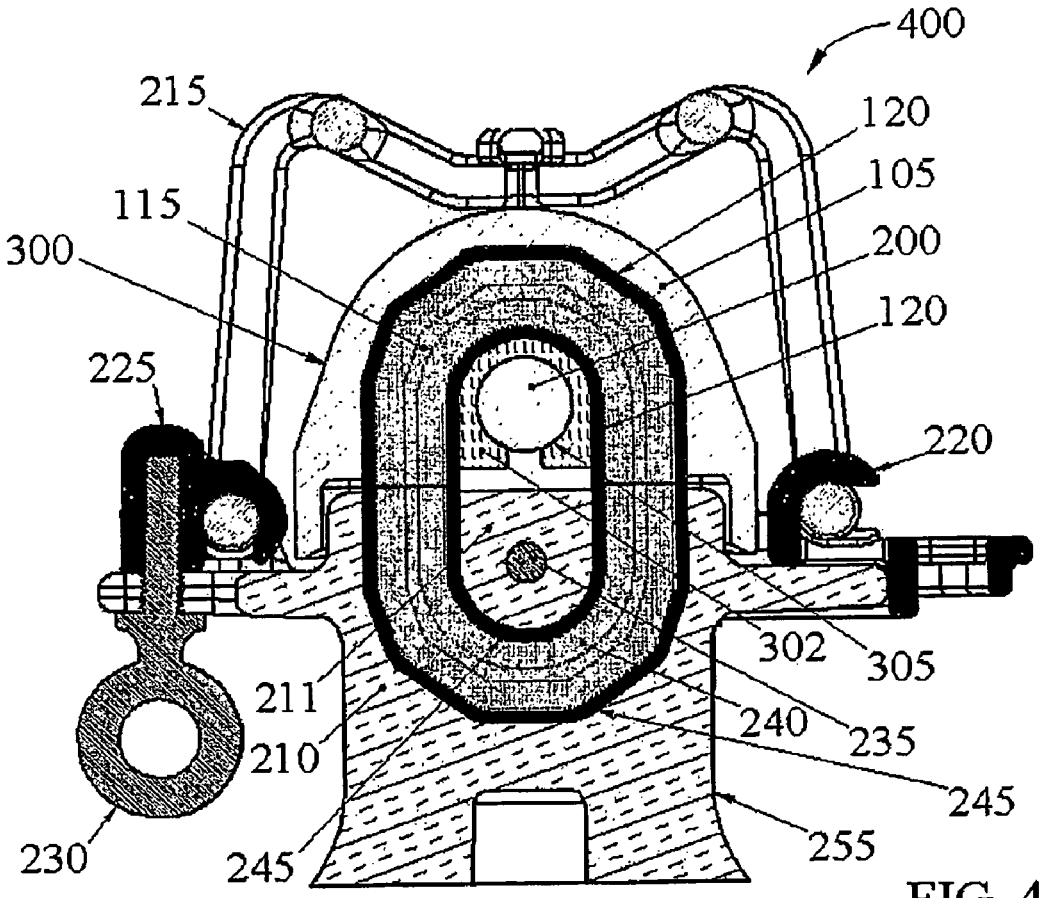
FIG. 4 is a cross-sectional view of an inductive coupler cover having a member fabricated of a conductive material configured as an open profile, compressed to maintain a constant connection between a magnetic core and a power line.

FIG. 4 is a cross-sectional view of an inductive coupler 400 that includes cover 300. Power line 200 is nested in member 305, where material of member 305 is deflected so that member 305 maintains electrical continuity between power line 200 and power line connection 302. Thus, member 305 also maintains an electrical connection between magnetic core section 115 and power line 200. This assures consistent frequency signal transfer from power line 200 through inductive coupler 400 and onto other devices (not shown).

Figure 5:
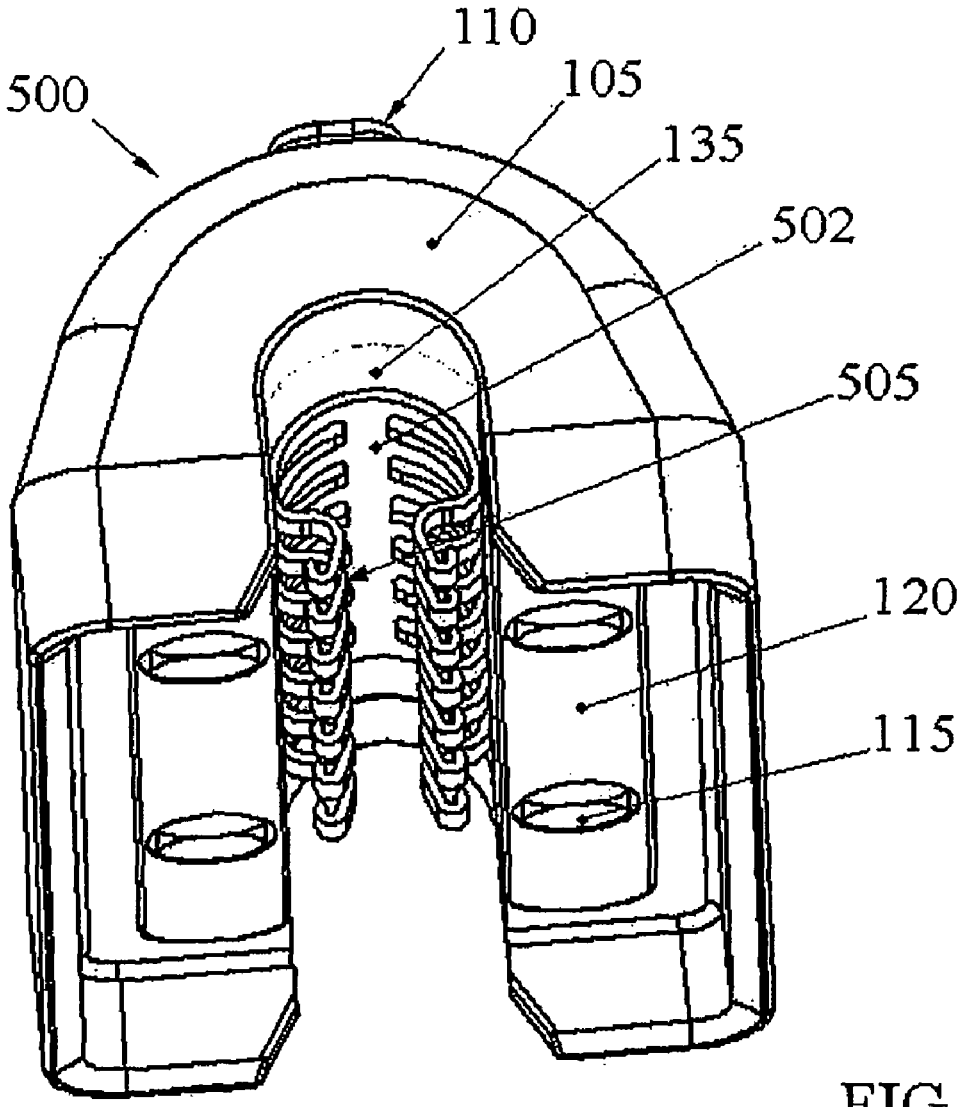
FIG. 5 is a three-dimensional view of an inductive coupler having a member fabricated of a conductive material configured as a spring-loaded open profile, located on the inside aperture of an upper magnetic core portion.

FIG. 5 shows a three-dimensional view of a cover 500 having a member 502 that is fabricated of a conductive or semiconductive material, and configured as a spring-loaded "open" profile. Member 502 includes spring-loaded feet 505, and can be mechanically fastened or physically placed into aperture 135.

Figure 6:
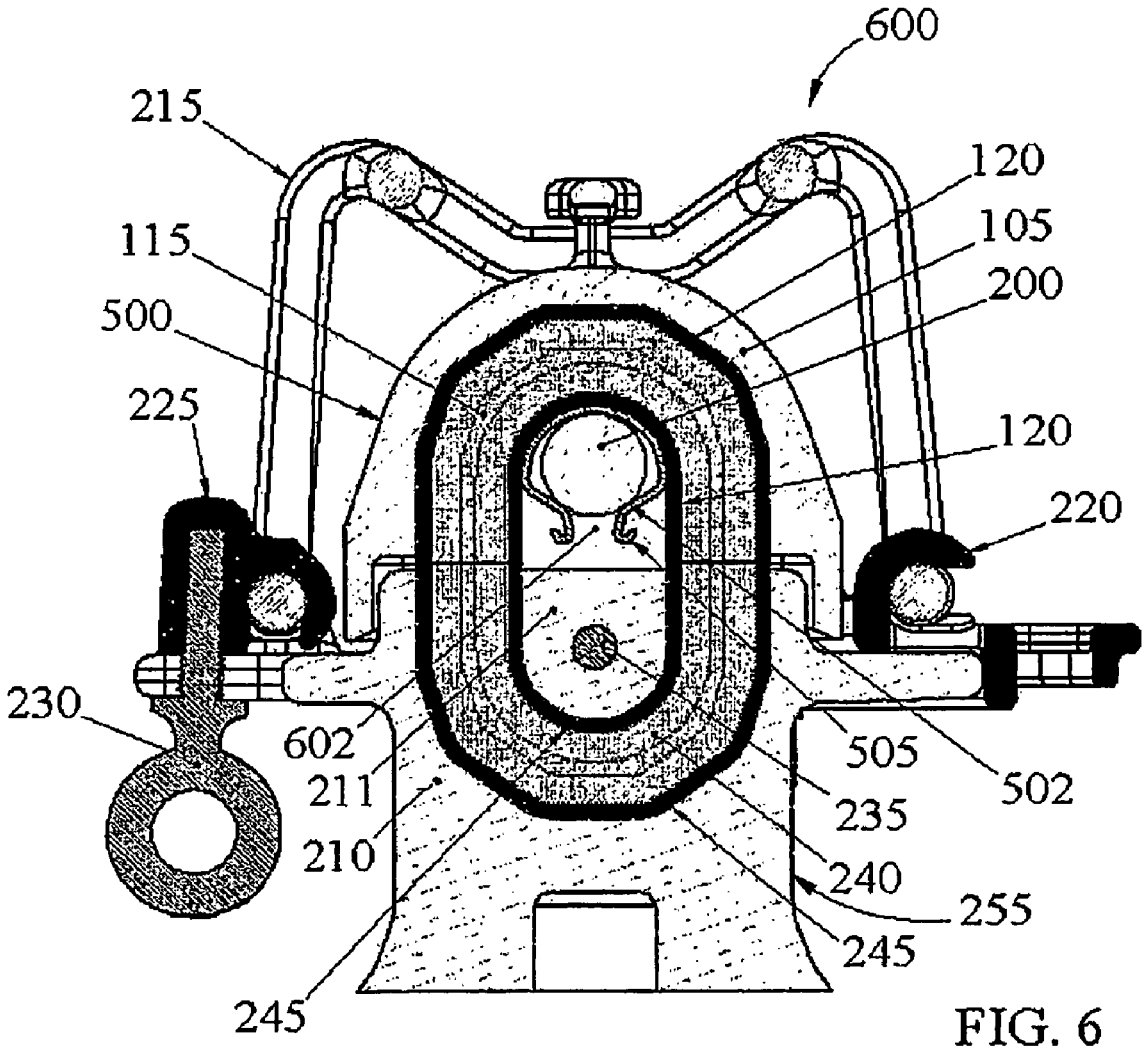
FIG. 6 is a cross-sectional view of an inductive coupler having a member fabricated of a conductive material configured as a spring-loaded open profile, expanded to maintain a constant connection between a magnetic core and a power line.

FIG. 6 is a cross-sectional view of an inductive coupler 600 that includes cover 500. Member 502 expands to allow power line 200 to slide into an opening 602. Member 502 is made of a resilient material, such that when spring-loaded feet are spread apart from one another, they have a tendency to return to their non-spread positions. Accordingly, spring-loaded feet 505 spring back around power line 200, and clasp power line 200 to maintain a constant connection with power line 200. Shear forming and metal stamping processes are well suited for developing member 502.

Figure 7:
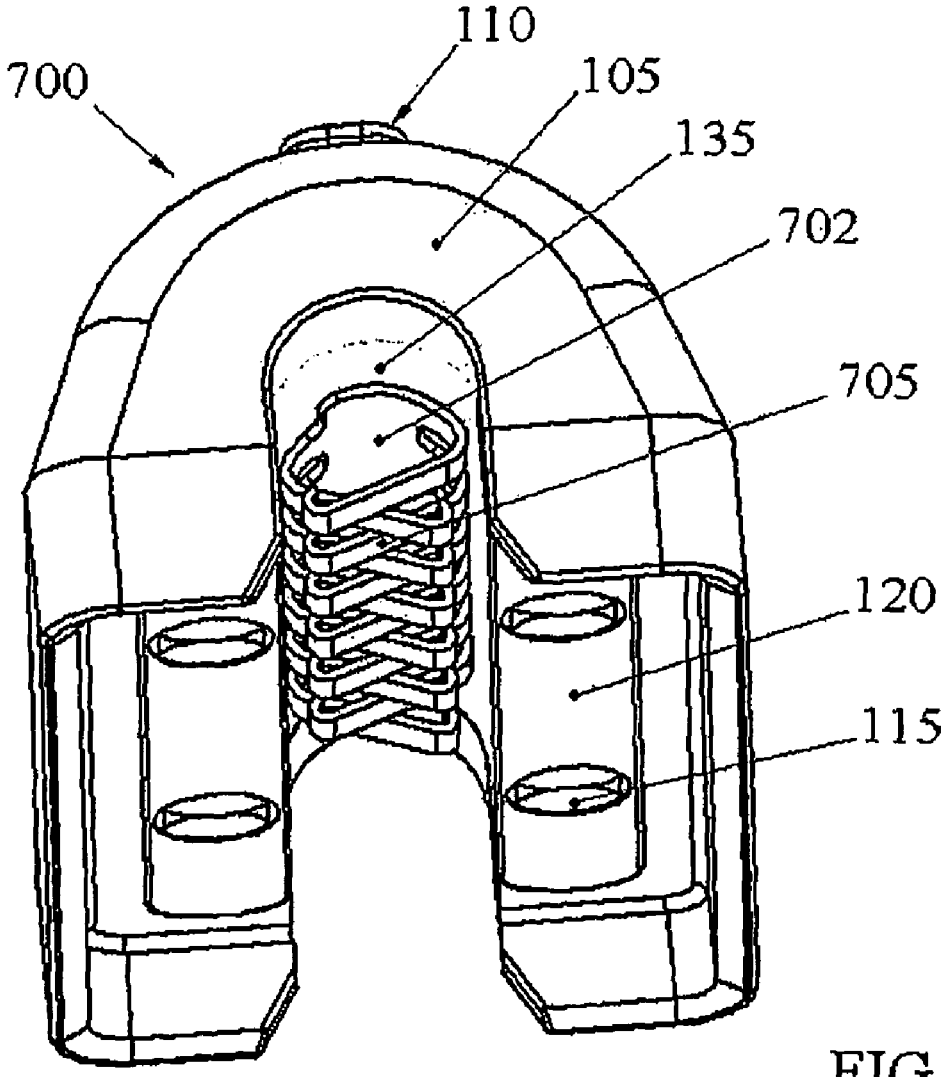
FIG. 7 is a three-dimensional view of an inductive coupler cover having a member fabricated of a conductive material configured as a spring-loaded open profile, located on the inside aperture of an upper magnetic core portion.

FIG. 7 shows a three-dimensional view of a cover 700 that utilizes a member 702 that is fabricated of a conductive or semiconductive material, and configured as a spring-loaded "closed" profile. Member 702 has spring-loaded contact fingers 705. Member 702 is defined as a cross-section with one or more openings of air parallel to the primary power line, and can be mechanically fastened or physically placed into aperture 135.

Figure 8:
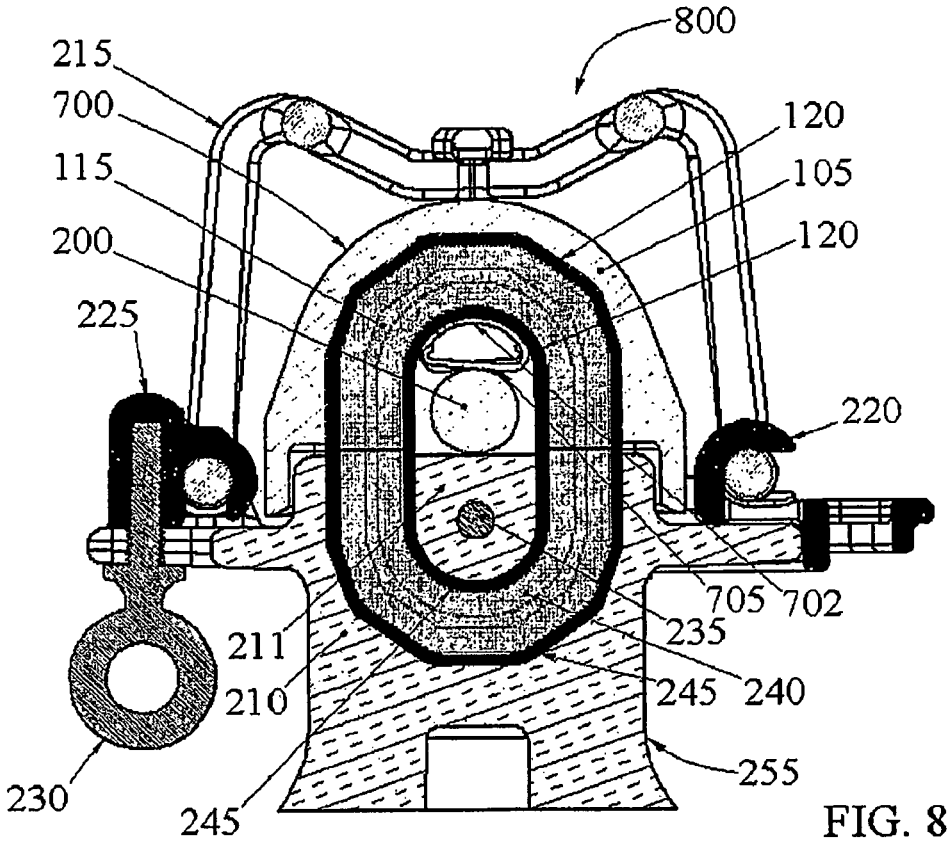
FIG. 8 is a cross-sectional view of an inductive coupler having a member fabricated of a conductive material configured as a spring-loaded closed profile, compressed to maintain a constant connection between a magnetic core and a power line.

FIG. 8 is a cross-sectional view of an inductive coupler 800 that includes cover 700. Member 702 is made of a resilient material. Member 702 compresses under load when inductive coupler 800 is installed onto power line 200, and maintains an electrical connection between member 702 and power line 200, regardless of movement of power line 200 because spring-loaded contact fingers 705 will spring back to their original position if any load is removed.

Figure 9:
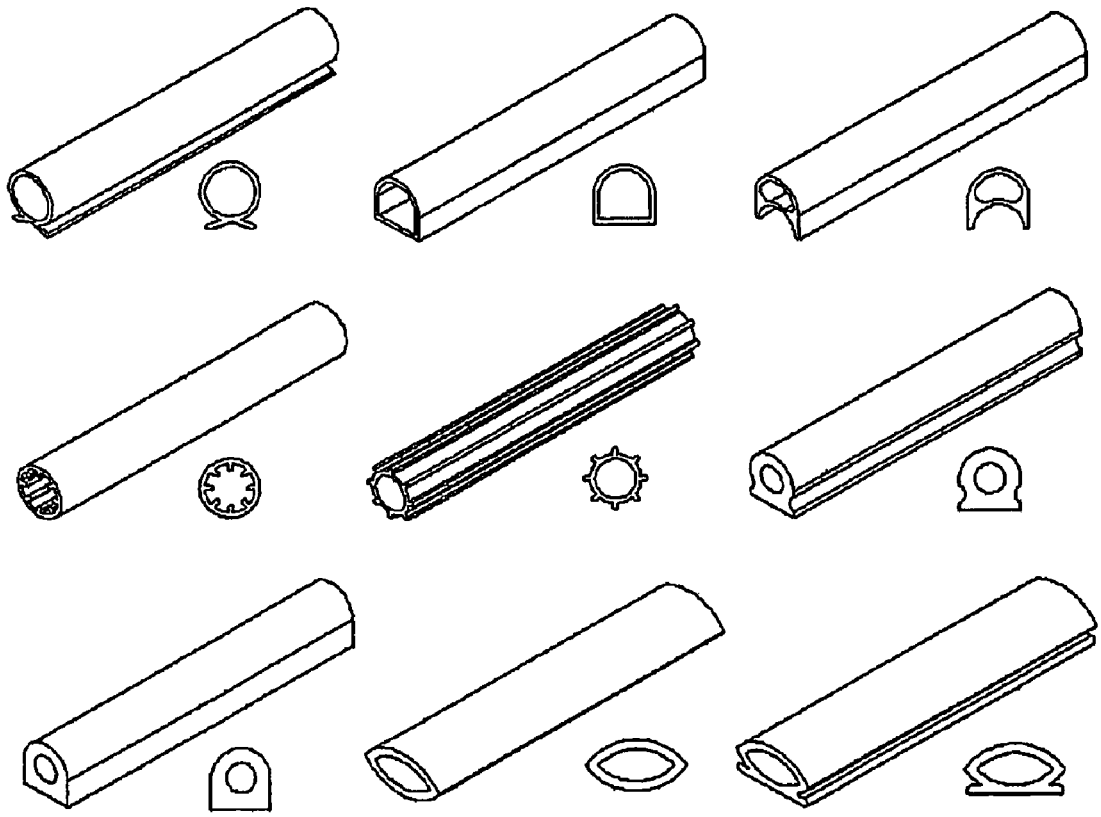
FIG. 9 shows some exemplary configurations of members having closed profiles.

FIG. 9 shows some exemplary configurations of members having a "closed" profile. "Closed" profiled members are most likely formed through extrusion molding.

Figure 10:
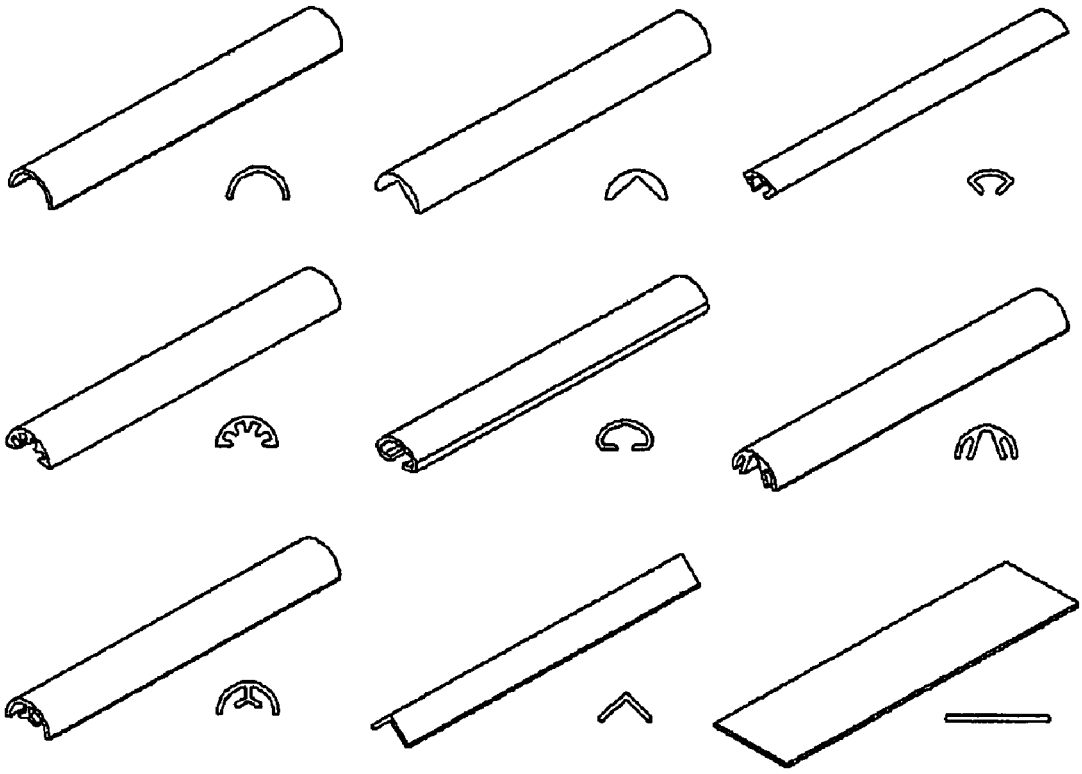
FIG. 10 shows some exemplary configurations of members having open profiles.

FIG. 10 shows some exemplary configurations of members having an "open" profile. "Open" profiled members are most likely formed through extrusion molding or injection molding.

An elastomer material having a hardness in a Hardness Type Shore A Durometer reading of degrees ranging from about 1 to about 100 is preferred for members 125 (FIG. 1) and 305 (FIG. 3), and also for the profiled members shown in FIG. 9 and FIG. 10.

A conductive metal material is preferred for members 502 (FIG. 5) and 702 (FIG. 7). All of the profiled members described herein are fabricated of a material that is either conductive or semiconductive. Preferably, the material has a volume resistivity between about 1.0 E-11 and about 100,000 ohm-cm.

Figure 11:
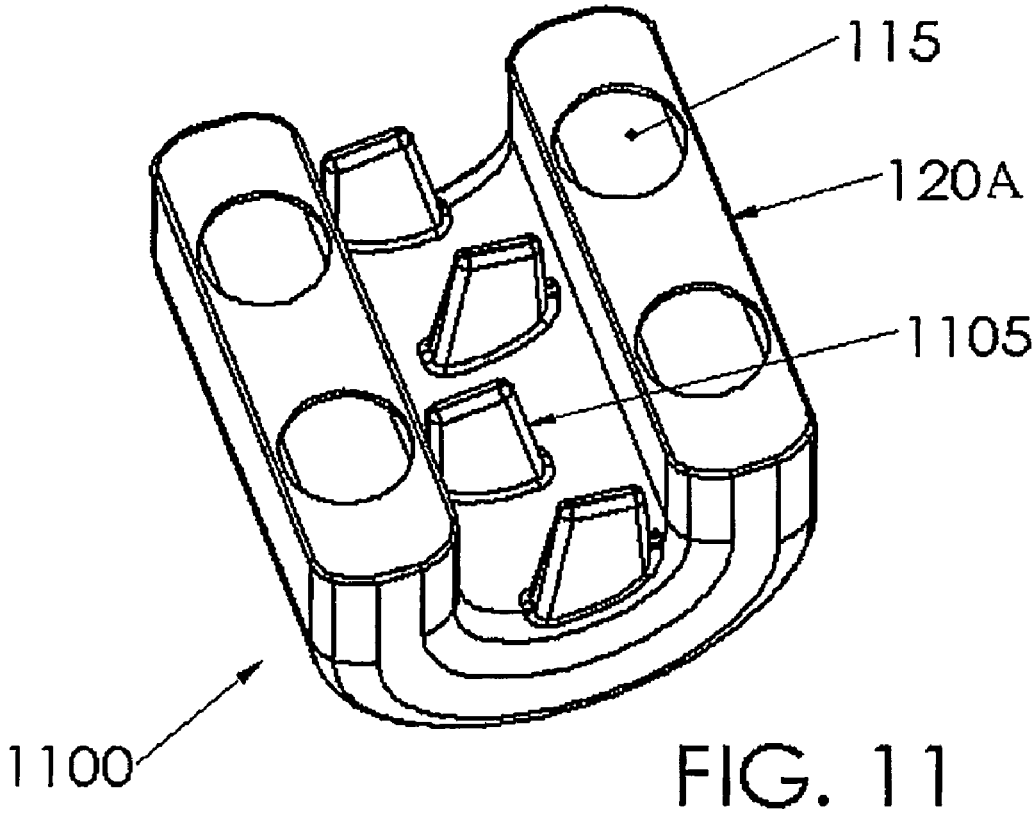
FIG. 11 is a three-dimensional view of an inductive coupler magnetic core having a member that provides an electrical connection, configured with a spring loaded open profile, and being integrated into a conductive sheath that surrounds the magnetic core.

FIG. 11 shows a magnetic core cover 1100 having a sheath 120A that includes protrusions 1105. That is, sheath 120A, when being fabricated, is molded to include protrusions 1105. Sheath 120A envelopes magnetic core section 115. Sheath 120A is made of a material having conductive or semiconductive properties. When magnetic core cover 1100 is installed on a power line, protrusions 1105 contact the power line and thus provide an electrical connection between the power line and magnetic core section 115, regardless of the size or position of the power line.

Figure 12:
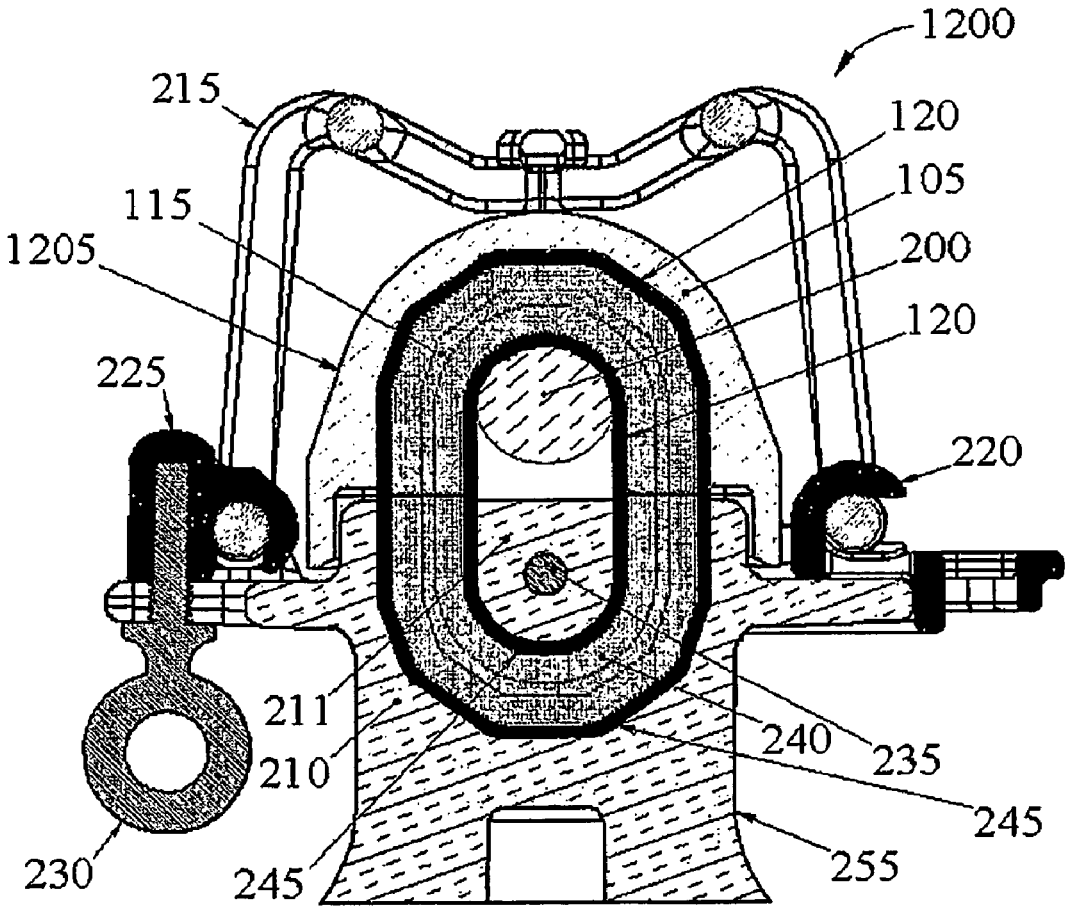
FIG. 12 is a cross-sectional view of an inductive coupler having a conductive sheath that surrounds a magnetic core without any additional profile, where the conductive sheath provides an electrical connection between a power line and the magnetic core.

FIG. 12 shows a cross-section of an inductive coupler 1200 having an inductive coupler cover 1205. Inductive coupler 1200 hangs directly on power line 200. The weight of inductive coupler 1200 is great enough to ensure that sheath 120 rests on, and maintains contact with, power line 200. If power line 200 moves, inductive coupler 1200 moves in the same direction as power line 200. Since sheath 120 is conductive or semiconductive, sheath 120 maintains an electrical connection between magnetic core section 115 and power line 200.

Figure 12A:
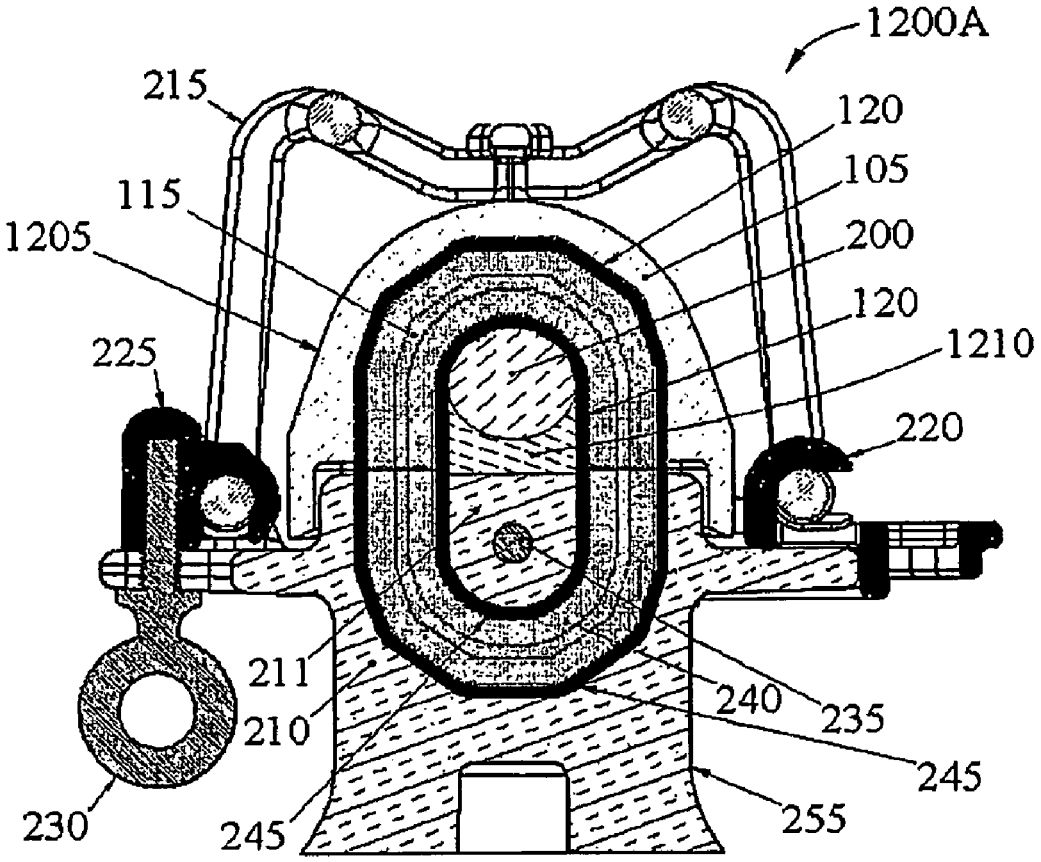
FIG. 12A is a cross-sectional view of an inductive coupler that includes a component that ensures a mechanical connection between a power line and sheath of the inductive coupler.

FIG. 12A shows a cross-section of an inductive coupler 1200A that includes a component 1210 that ensures that power line 200 and sheath 120 contact one another. Component 1210 is made of a compressible material having a non-compressed dimension that is greater than a distance between insulation 211 and power line 200. When inductive coupler 1200A is installed on power line 200, component 1210 is compressed and applies a force against power line 200 that ensures the maintenance of the contact between power line 200 and sheath 120. Since sheath 120 is conductive or semiconductive, the combination of component 1210 and sheath 120 maintain an electrical connection between magnetic core section 115 and power line 200, via sheath 120.

Figure 12B:
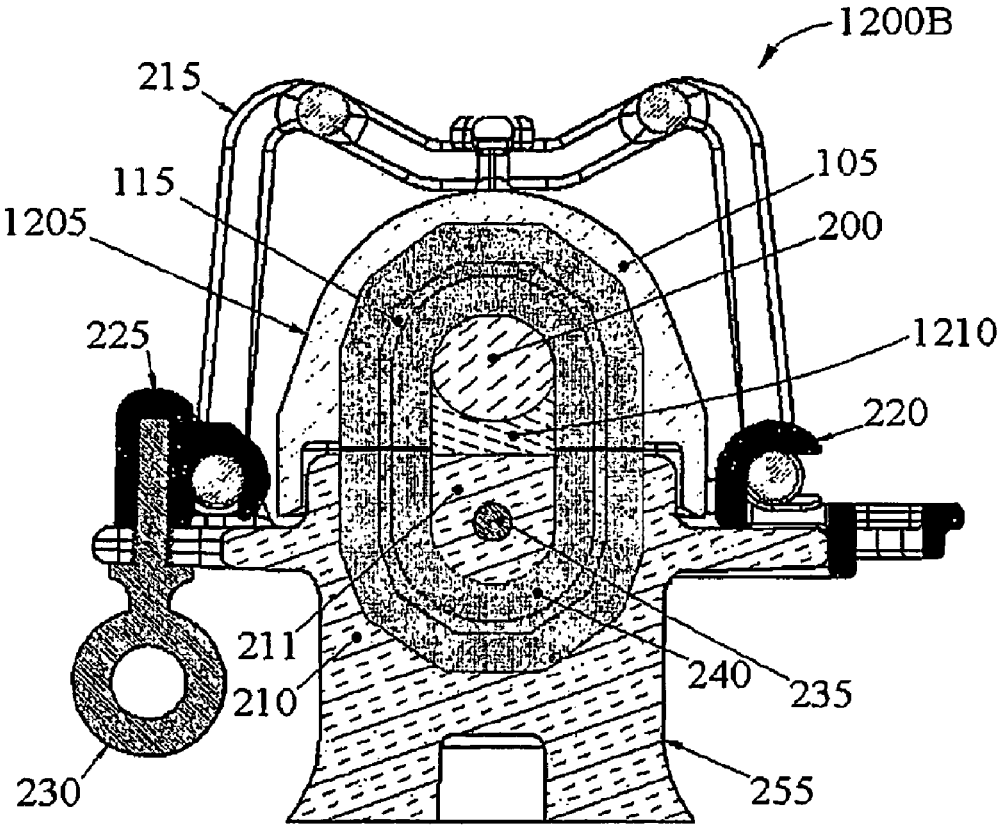
FIG. 12B is a cross-sectional view of an inductive coupler that includes a component, similar to that of FIG. 12A, that ensures a mechanical connection between a power line and a magnetic core of the inductive coupler, but without an accompanying sheath.

FIG. 12B is a cross-sectional view of an inductive coupler 1200B that, similarly to inductive coupler 1200A, includes a component 1210. However, inductive coupler 1200B, in contrast with inductive coupler 1200A, does not include sheath 120. In inductive coupler 1200B, component 1210 is compressed and applies a force against power line 200 that ensures that power line 200 and magnetic core section 115 contact one another directly.

Figure 12C:
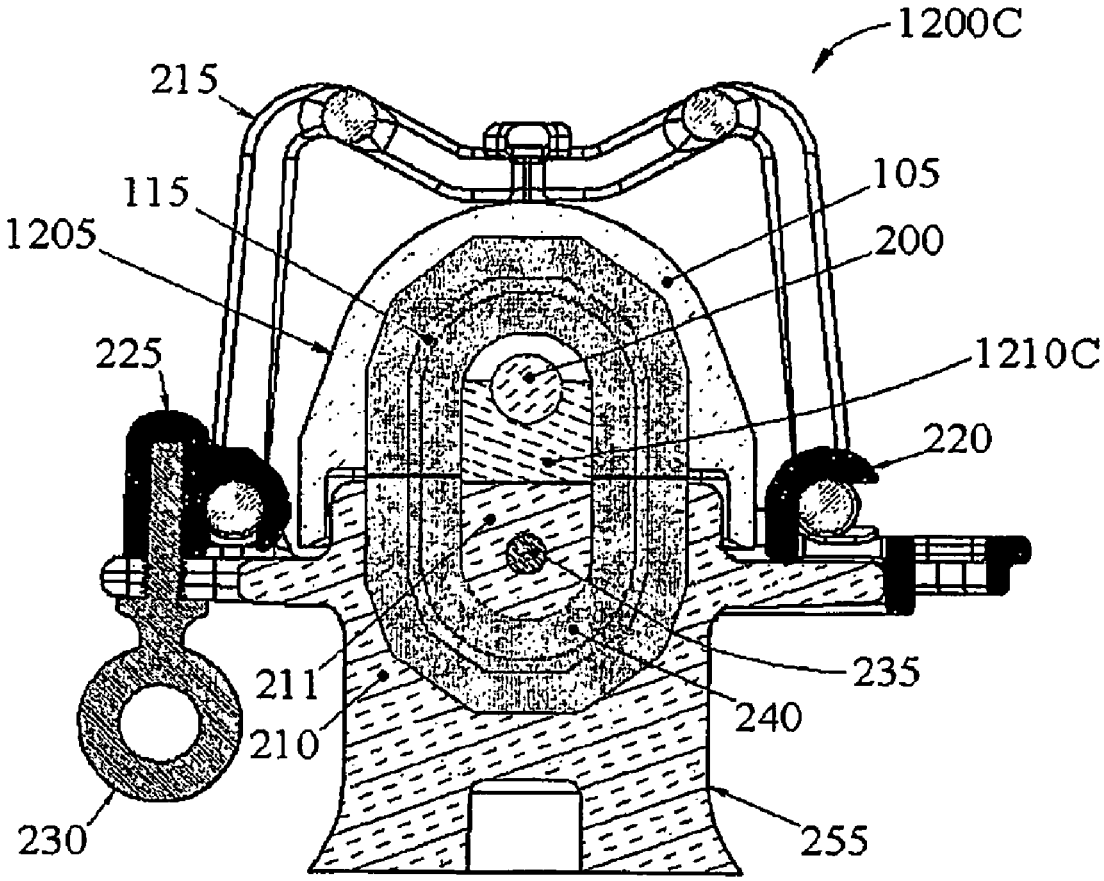
FIG. 12C is a cross-sectional view of an inductive coupler that includes a component made of a compressible material that is also conductive or semiconductive, that maintains an electrical connection between a magnetic core of the inductive coupler and a power line.

FIG. 12C is a cross-sectional view of an inductive coupler 1200C that includes a component 1210C made of a compressible material that is also conductive or semiconductive. Inductive coupler 1200C does not include sheath 120. Component 1210C, along its sides, is in contact with magnetic core section 115. When inductive coupler 1200C is installed on power line 200, power line 200 makes contact with component 1210C, which, in turn, maintains an electrical connection between power line 200 and magnetic core section 115. In inductive coupler 1200C, since component 1210C is conductive or semiconductive, power line 200 and magnetic core section 115 need not be in direct contact with one another.

Component 1210C can be used in inductive couplers 1200A and 1200B, in place of component 1210. If component 1210C is used in inductive coupler 1200A, component 1210C will provide an additional electrical connection between power line 200 and sheath 120. If component 1210C is used in inductive coupler 1200B, component 1210C will provide an additional electrical connection between power line 200 and magnetic core section 115.

Figure 13:
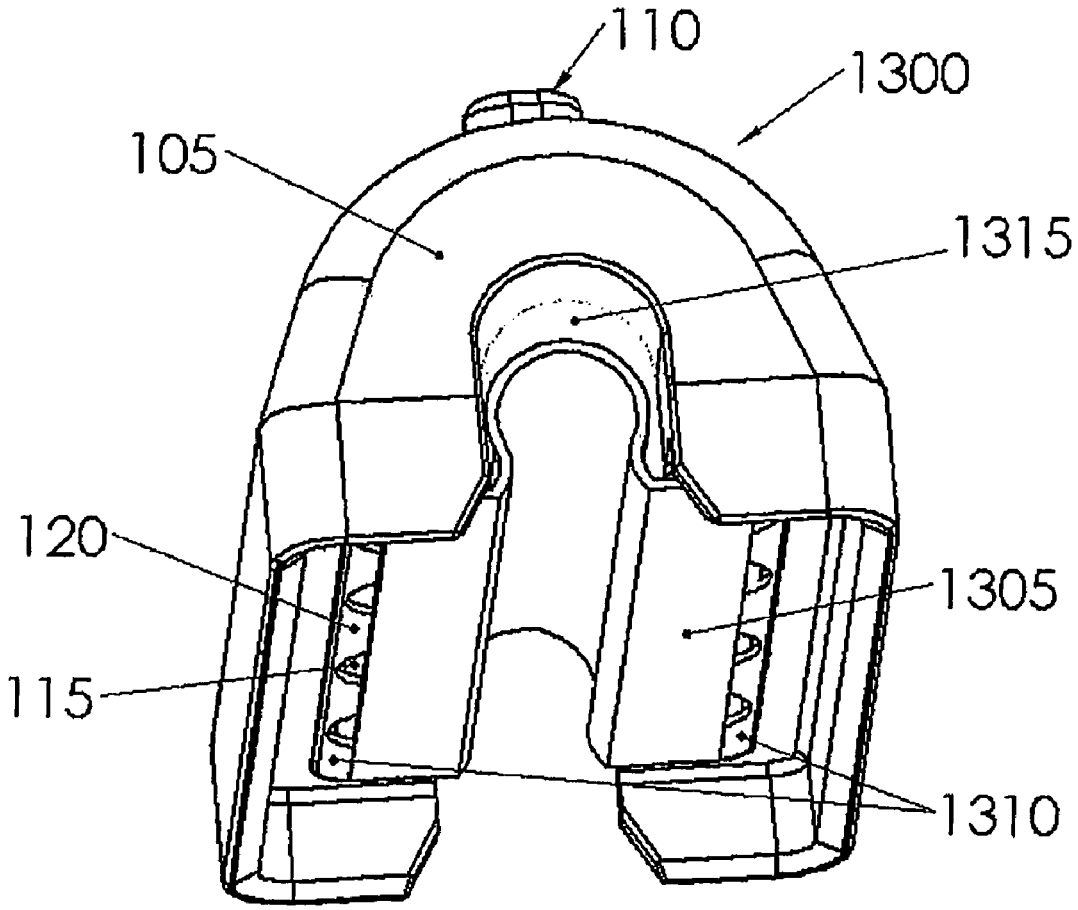
FIG. 13 is a three-dimensional view of an inductive coupler cover having a member fabricated of a sheet made with conductive material, configured as a open profile, located on pole faces and an inside aperture of a portion of a magnetic core.

FIG. 13 is a three-dimensional view of a cover 1300 that employs a profiled member 1305. Profiled member 1305 is fabricated of a sheet made of conductive or semiconductive material. Profiled member 1305 is situated on pole faces 1310 of magnetic core section 115 and adjacent to an inside aperture 1315 of magnetic core section 115. Cover 1300, when installed on a power line (e.g., power line 200) and fastened to a base (e.g., base 255), compresses profiled member 1305 between magnetic core section 115 and another magnetic core section, (e.g., magnetic core section 240). The compression force holds profiled member 1305 in place. However, other arrangements (e.g., component 1210) may be provided to hold profiled member 1305 in place. Profiled member 1305 deflects under load to maintain an electrical contact with power line 200, regardless of power line 200's cross-sectional diameter size or position within aperture 1315. Accordingly, when cover 1300 is installed on the power line, sheath 120 and profiled member 1305, together, maintain an electrical connection between magnetic core section 115 and the power line.

Figure 13A:
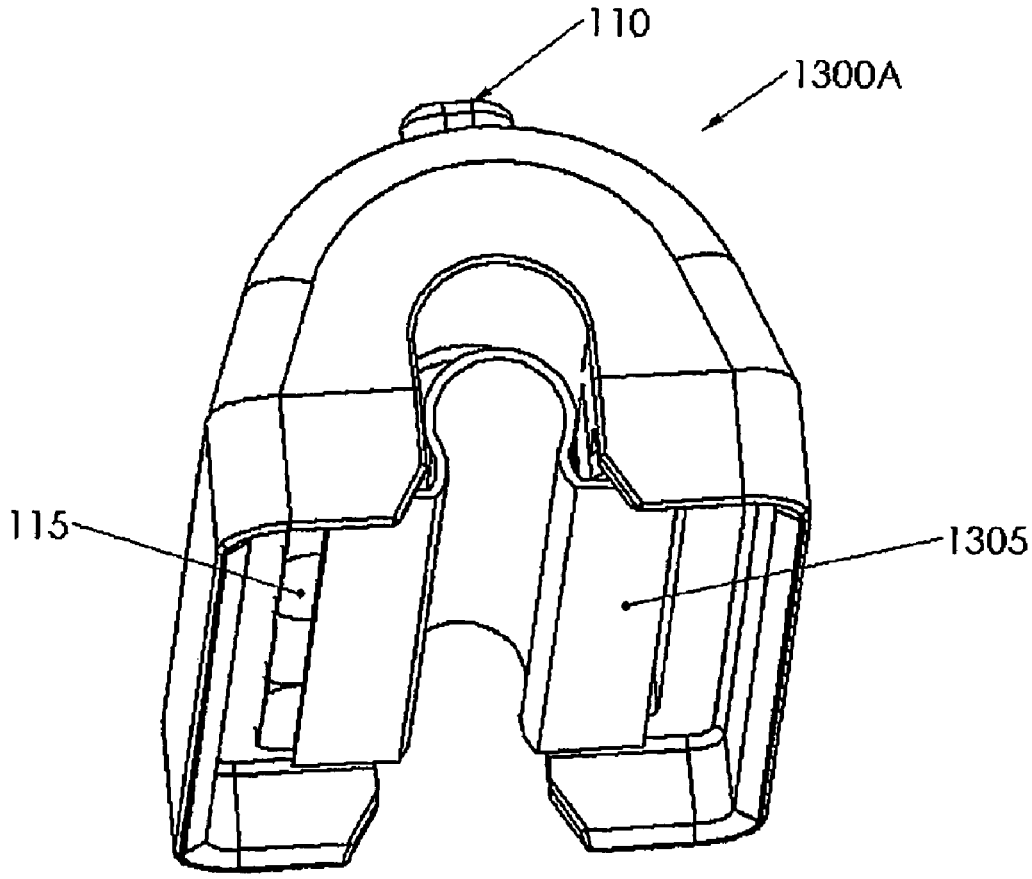
FIG. 13A is a three-dimensional view of an inductive coupler cover that employs profiled member, similarly to the inductive coupler cover of FIG. 13, but in contrast with FIG. 13, does not include sheath.

FIG. 13A is a three-dimensional view of a cover 1300A that, similarly to cover 1300, employs profiled member 1305, but in contrast with cover 1300, does not include sheath 120. When cover 1300A is installed on a power line, profiled member 1305 contacts magnetic core section 115 and the power line, thus maintaining an electrical connection between magnetic core section 115 and the power line.

All of the embodiments described herein include a member that maintains an electrical connection between a magnetic core and a conductor. In practice, the member can be any of (a) a combination of a sheath and a profiled member (e.g., FIGS. 1-8 and 13), (b) a sheath that also serves as a profiled member (e.g., FIG. 11), (c) a sheath without an accompanying profiled member (e.g., FIG. 12), (d) a combination of a sheath and a component of a compressible material (e.g., FIG. 12A), (e) a component of a compressible material that is conductive or semiconductive, without an accompanying sheath (e.g., FIGS. 12B and 12C), or (f) a profiled member without an accompanying sheath (e.g. FIG. 13A).

The techniques described herein are exemplary, and should not be construed as implying any particular limitation on the present invention. It should be understood that various alternatives, combinations and modifications could be devised by those skilled in the art. The present invention is intended to embrace all such alternatives, modifications and variances that fall within the scope of the appended claims.

What is claimed is:

1. An inductive coupler for coupling a signal to a conductor, comprising:

a magnetic core having an aperture through which said conductor is routed when said inductive coupler is installed on said conductor;

a winding wound around a portion of said magnetic core, wherein said signal is coupled between said winding and said conductor via said magnetic core; and a conductive or semiconductive sheath that envelopes said magnetic core, has a protrusion that contacts said conductor, and thus maintains an electrical connection between said magnetic core and said conductor.

2. The inductive coupler of claim 1, wherein said conductive or semiconductive sheath has a volume resistivity between about 1.0 E-11 and about 100,000 ohm-cm.

3. The inductive coupler of claim 1, wherein said conductor carries a voltage between about 90 to 600 volts.

4. The inductive coupler of claim 1, wherein said conductor carries a voltage between about 2,400 volts to 35,000 volts.

5. The inductive coupler of claim 1, wherein said signal has a frequency of greater than or equal to about 1 megahertz.

6. An inductive coupler for coupling a signal to a conductor, comprising:

a magnetic core having an aperture through which said conductor is routed when said inductive coupler is installed on said conductor;

a winding wound around a portion of said magnetic core, wherein said signal is coupled between said winding and said conductor via said magnetic core;

a conductive or semiconductive sheath that envelopes said magnetic core; and a component that applies a force against said conductor so that said conductor maintains contact with said sheath, and thus maintains an electrical connection between said magnetic core and said conductor.

7. An inductive coupler for coupling a signal to a conductor, comprising:

a magnetic core having an aperture through which said conductor is routed when said inductive coupler is installed on said conductor;

a winding wound around a portion of said magnetic core, wherein said signal is coupled between said winding and said conductor via said magnetic core;

a conductive or semiconductive sheath that envelopes said magnetic core, and has a protrusion extending toward said conductor; and a component that applies a force against said conductor so that said conductor maintains contact with said protrusion, and thus maintains an electrical connection between said magnetic core and said conductor.

* * * * *